US005775683A

United States Patent [19]

Rodi

[11] Patent Number: 5,775,683

[45] Date of Patent: Jul. 7, 1998

[54] METHOD FOR TRANSPORTING HANDLING SHEETS

[75] Inventor: Anton Rodi, Leimen, Germany

[73] Assignee: Heidelberger Druckmaschinen AG, Heidelberg, Germany

[21] Appl. No.: 904,378

[22] Filed: Aug. 1, 1997

Related U.S. Application Data

[63] Continuation of Ser. No. 424,154, Apr. 17, 1995, abandoned.

[30] Foreign Application Priority Data

Apr. 15, 1994 [DE] Germany ..... 44 13 238.7
Mar. 8, 1995 [DE] Germany ..... 195 08 254.0

[51] Int. Cl.[6] ..... B65H 83/00

[52] U.S. Cl. ..... 271/3.15; 271/3.14; 271/9.09; 271/4.03; 271/3.13

[58] Field of Search ..... 271/3.09, 3.11, 271/3.13, 3.15, 4.02, 4.03, 3.4, 9.09, 5, 107, 314; 414/797

[56] References Cited

U.S. PATENT DOCUMENTS

| | | | |
|---|---|---|---|
| 2,561,030 | 7/1951 | Morse | 271/3.11 |
| 3,947,016 | 3/1976 | Horung et al. . | |
| 4,171,130 | 10/1979 | Jeschke et al. . | |
| 4,318,540 | 3/1982 | Paananen . | |
| 4,629,172 | 12/1986 | Kameyama et al. . | |
| 4,790,524 | 12/1988 | Murakamietal | 271/9.09 |
| 5,018,716 | 5/1991 | Yoshida et al. | 271/3.13 X |
| 5,121,914 | 6/1992 | Hargreaves . | |
| 5,197,723 | 3/1993 | Yamada et al. | 271/3.15 |

FOREIGN PATENT DOCUMENTS

| | | | |
|---|---|---|---|
| 0 367 048 A2 | 5/1990 | European Pat. Off. . | |
| 1183100 | 5/1969 | Germany . | |
| 2 230 421 | 1/1974 | Germany . | |
| 2324261 | 11/1974 | Germany . | |
| 2758007 | 10/1979 | Germany . | |
| 3736841 | 5/1989 | Germany . | |
| 4210958 | 10/1993 | Germany . | |
| 57-67431 | 4/1982 | Japan | 271/9.09 |
| 186101 | 7/1993 | Japan | 271/4.03 |
| 918008 | 2/1963 | United Kingdom . | |
| 2130560 | 6/1984 | United Kingdom | 271/3.13 |
| 2245548 | 1/1992 | United Kingdom | 271/3.13 |

*Primary Examiner*—Frank E. Werner
*Attorney, Agent, or Firm*—Herbert L. Lerner; Laurence A. Greenberg

[57] ABSTRACT

Method for transporting/handling sheets along at least one transport/handling segment in a machine includes supplying sheets to and removing sheets from the machine, the transport/handling segment having a period length for successive sheets which is dependent upon the format length of the respective sheets.

26 Claims, 3 Drawing Sheets

METHOD FOR TRANSPORTING HANDLING SHEETS

This application is a continuation of application Ser. No. 08/424,154, filed on Apr. 17, 1995 now abandoned.

BACKGROUND OF THE INVENTION

Field of the Invention

The invention relates to a method for transporting/handling sheets along at least one transport/handling segment or the like, hereinafter referred to as a segment, in a machine, in particular for supplying and removing sheets to be printed as well as printed sheets, respectively, to and from at least one printing unit of a sheet-fed printing press.

Methods for transporting/handling or the like of sheets in a machine, such as a sheet-fed printing press, have become known heretofore. When the term "transporting" is used hereinafter, this is merely for the sake of simplicity. "Transporting" should also be understood to include any handling or processing of any kind during sheet movement. The transporting of the sheets is effected along a more-or-less long path within the press, and this path should be thought of at least conceptually as being subdivided into segments. In the simplest case, the transport takes place along one segment inside the press; by way of example, it may be a transporting segment or a handling or processing segment or the like. The foregoing considerations apply not only to heretofore known methods but also for the subject of the method according to the invention of the instant application.

Heretofore known methods operate on the principle of a constant period length. This means that the period of time for transporting, handling or processing, and so forth of sheets is constant, and in particular is formed in terms of revolutions; that is, it is determined by one complete revolution of one element of the press, such as the impression cylinder of a sheet-fed printing press.

This "orientation to revolutions" results in a rigid handling or processing rhythm, or in other words there is no flexibility in the handling or processing. This inflexibility also exists, for example, in machines or presses having elements which are intrinsically not subject to a rigid period length. One example is a copier, which has feeding and delivering devices for the paper (which is in sheet form) determined by this "orientation to revolutions", but also has a toner cylinder which does not adhere to this "orientation to revolutions", and as a result the copier can handle various paper sizes and/or make enlargements and reductions. The herein aforementioned other devices of this machine, however, are indeed determined by the established paper size or format, analogously to the "orientation to revolutions" described hereinbefore.

SUMMARY OF THE INVENTION

It is accordingly an object of the invention to provide a method for transporting/handling sheets in a machine or press which avoids the herein aforementioned disadvantages of previously known methods of this general type.

With the foregoing and other objects in view, there is provided, in accordance with the invention, a method for transporting/handling sheets along at least one transport/handling segment in a machine, which comprises supplying sheets to and removing sheets from the machine, the transport/handling segment having a period length for successive sheets which is dependent upon the format length of the respective sheets.

In accordance with another aspect of the invention, there is provided a method for transporting/handling sheets along at least one transport/handling segment in a sheet-fed printing press, which comprises supplying to and removing from, at least one printing unit of the sheet-fed printing press, printed sheets and sheets to be printed, respectively, the transporting/handling segment having a period length for successive sheets which is dependent upon the format length of the respective sheets.

In accordance with another mode, the method according to the invention includes spacing the successive sheets a distance from one another independently of the format length of the sheets.

In accordance with a further mode, the method includes selectively predetermining the spacing between the successive sheets.

In accordance with an added mode, the method includes establishing the spaced distance between the successive sheets at less than approximately 20% of the format length of the respective sheets.

In accordance with an additional mode, the method includes selectively predetermining the spaced distance.

In accordance with yet another mode, the method includes establishing the spaced distance between the successive sheets at less than approximately 20% of a maximum format length of the sheets to be handled by the machine.

In accordance with yet a further mode, the method includes controlling/regulating at least one machine element of the machine in synchronism with at least one of the respective format length of the respective sheets and spaced distance between respective successive sheets.

In accordance with yet an added mode, the machine is a printing press and the machine element is at least one of a printing unit and feeding and delivery devices of the printing press.

In accordance with yet an additional mode, the method includes controlling/regulating at least one machine element of the machine in synchronism and/or in register with the leading edge of a respective sheet.

Thus, to achieve the object of the invention, the period length present in the segment for the transporting/handling or the like of successive sheets is dependent upon the format length of the sheets. The term "format length" of the sheets is understood to mean the length of the sheet format in the transporting or handling direction, which is to be distinguished from the format dimension crosswise, i.e., format width or breadth, in a direction extending transversely to the direction of transport or handling. According to the invention, the format length of each of successive sheets determines the period length, for example for the feeding and delivery devices of a sheet-fed printing press. The orientation to revolutions mentioned hereinbefore thus no longer exists. If the herein aforementioned sheet-fed printing press is considered to be the sheet-processing machine, the prerequisite is that there be an imprinting device that does not impose the orientation to revolutions upon the other elements of the machine or press. This type of printing device can, for example, be realized by means of a digitally triggerable printing cylinder, that is, this cylinder does not have a photomechanically produced printing plate but rather has electronically triggerable pixels, which make it possible during printing to vary the subject, or its size, continuously, which means that extremely high flexibility is afforded. Because of the procedure according to the invention, this high flexibility is then adapted to the other elements of the machine or press as well, so that the overall result is optimal operation of the machine. By means of the procedure according to the invention, the distances between successive sheets or the periods of time between successive sheets are not fixed to a maximum format length, so that if the format length becomes smaller, the distances between sheets become correspondingly larger; instead, they can be predetermined in such a manner that even if the format becomes smaller, these spacings and the spacing times, respectively, can be maintained or even decreased.

In particular, the spaced distance between successive sheets is arbitrarily predeterminable, independently of the format length of the particular sheet being used at the moment. The sheet spacing can thus be defined beforehand and maintained during the transporting/handling process, and there is no dependency upon format.

In particular, it is advantageous if the spaced distance between successive sheets is less than approximately 20% of the particular format length of the sheets involved, or can be predetermined arbitrarily or selectively. In sheet-fed printing presses, spacings greater than or equal to 20% of the maximum format length of the sheets are involved, in the heretofore known methods of this general type. These spacings result from the fact that the printing form has a lock-up or cylinder gap or clamping channel, which is not available for printing and, of the total circumference of the plate cylinder, occupies a segment which is larger than the aforementioned 20% of the total circumference. According to the invention, the transport or handling of successive sheets, because of the format-dependently selected period length, is by comparison effected so that the spacings are less than 20% of the particular sheet format length used at the moment.

As an alternative to the aforedescribed dependency of the spacing or distance between successive sheets on the format length, it is also possible, in another exemplary embodiment, for this dependency to be based not on the particular format length but rather on the maximum format length of the sheets, so that the spacing is a constant, format-independent value. In a further exemplary embodiment, it is also possible for the spacing of successive sheets not to assume a fixed value but rather an arbitrarily predeterminable value; it is either less than 20% of the format length of the particular sheets being used, or less than 20% of the maximum format length of the sheets to be handled by the machine.

In a preferred exemplary embodiment of the invention, open/closed-loop control, i.e., control/regulation, of elements of the machine is effected synchronously with the particular format length involved and/or with the spaced distances between the sheets, which in particular are selective or arbitrary. In the case of a sheet-fed printing press, the aforementioned machine or press elements may be a printing unit and/or feeder and/or delivery or removal devices for the sheets. Provision is accordingly made so that the machine elements are adapted to one another and in particular synchronized to one another so that optimal handling can be effected as a function of the format length or as a function of the spaced distances which are selected.

It is also possible to perform open-/closed-loop control, i.e., control/regulation, of elements of the machine, in particular of the printing unit and/or of feeding and/or of delivery or removal devices of the sheet-fed printing press, synchronously and/or in register with the leading edge of the particular sheet.

In accordance with another mode, the method according to the invention includes determining at least once the position of the sheet in the transport/handling segment, introducing a new sheet into the segment the instant the trailing edge of the preceding sheet has reached a given position.

In accordance with a further mode, the method includes determining the position of the sheet by means of a first sheet sensor.

In accordance with an added mode of the method according to the invention, the sheet position is calculated.

In accordance with an additional mode, the method according to the invention includes determining the position of the sheet by determining the location of the leading edge of the sheet.

In accordance with yet another mode, the method includes calculating the position of the trailing edge of the sheet.

In accordance with yet a further mode, the method includes determining the sheet length by means of a length sensor or from data introduced into a control device of the press.

In accordance with yet an added mode, the method includes determining the sheet length by measuring a test sheet.

In accordance with yet an additional mode, the method includes introducing the new sheet when the trailing edge of the preceding sheet has left the vicinity of a suction device for handling the sheet.

In accordance with another mode, the method includes, after introducing the new sheet, moving the new sheet to the trailing edge of the preceding sheet in a manner that a predetermined spaced distance is formed between the trailing edge of the preceding sheet and the leading edge of the new sheet.

In accordance with a further mode, the method includes setting the spaced distance between the preceding sheet and the new sheet at zero distance.

In accordance with an added mode, the method includes determining the location of the sheet in the segment a second time and, by means of which triggering a subject of at least one reprintable, particularly digitally triggerable impression cylinder.

In accordance with an additional mode, the method includes determining the location of the leading edge of the respective new sheet in the second determination.

In accordance with a concomitant mode, the method includes channeling a single sheet into the segment by introducing a single sheet into a position on a single-sheet unit, detecting the single sheet in the single-sheet unit by means of a third determination of the position of the sheet and in accordance therewith as well as with the first determination of the position of the sheet and/or the second determination of the position of the sheet, channeling the sheet definitely between a preceding sheet and a new sheet.

Other features which are considered as characteristic for the invention are set forth in the appended claims.

Although the invention is illustrated and described herein as a method for transporting/handling sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENT

Figure 1A:
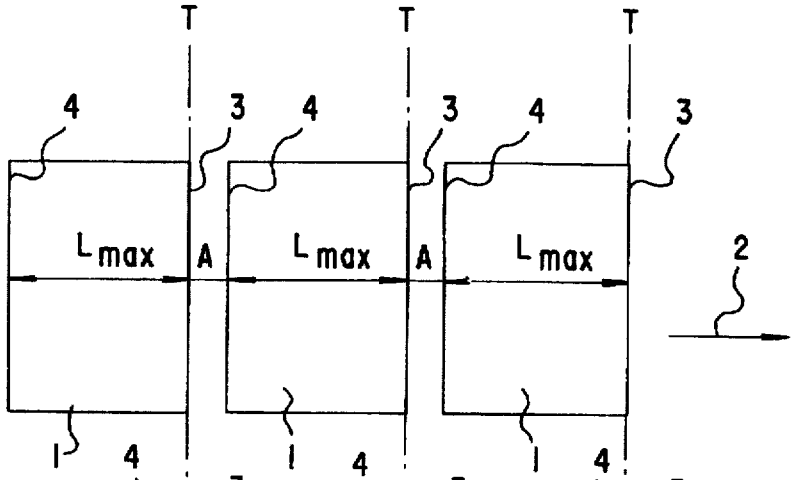
FIGS. 1*a* and 1*b* are diagrammatic plan views of respective successions of sheets in accordance with the method of the prior art.

Referring now to the drawings and, first, particularly to FIG. 1*a* wherein transport of sheets 1 is shown as taking place in the direction of the arrow 2 within an otherwise non-illustrated machine, for example, a sheet-fed printing press. It is apparent that the respective leading edge 3 of each of the sheets 1 coincides with the period length P of the revolution-oriented handling speed of the machine. The respective trailing edge 4 of each sheet has a given spacing or distance A from the leading edge 3 of the respective sheet 1 which follows it. The spacing A, in a sheet-fed printing press, is on the order of magnitude of ≧20% of the maximum lengthwise size $L_{max}$ of the sheets 1. The spacing A is the result of the size of the lock-up gap for securing a printing plate to the printing cylinder of the sheet-fed printing press, among other factors.

Figure 1B:
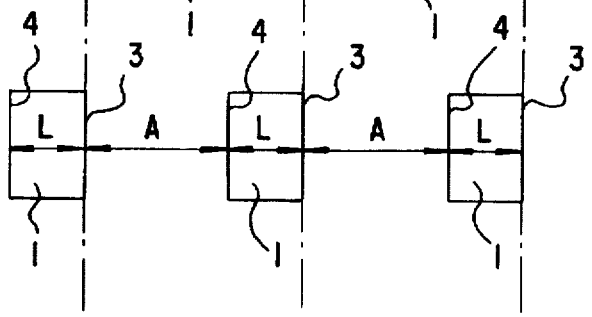

If, as in FIG. 1*b*, printing is then performed wherein the sheets 1 have a shorter format length L than the maximum format length $L_{max}$ the spacing A between the individual sheets 1 increases accordingly, because the leading edge 3 of each sheet continues to coincide with the period length T. This makes it quite clear that periods of time to be associated with the spacings A occur which represent "rest periods", or in other words periods which are not utilized for productivity.

Figure 2A:
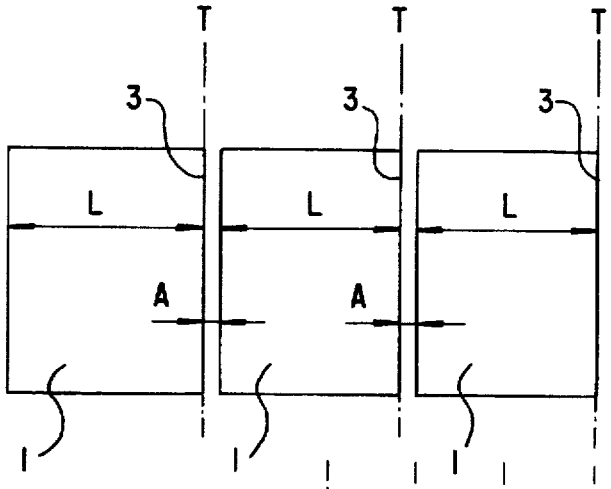
FIGS. 2*a* and 2*b* are diagrammatic plan views of respective successions of sheets in accordance with the method of the invention of the instant application.
Figure 2B:
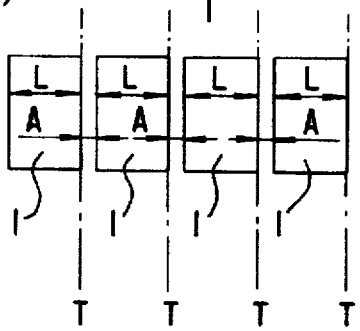

By comparison, if one were to consider the sheet succession or sequence carried out by the method of the invention and shown in FIG. 2*a*, once again, it would be noted that the leading edges 3 of the sheets coincide with the period length T, but the period length T is not fixedly predetermined but rather is determined by the format length L of the particular sheet 1. In other words, a flexible adaptable duration period as a function of the format length of the sheets 1 is involved. This is particularly clearly shown by FIG. 2*b*, in comparison with FIG. 2*a*. It is apparent that in the exemplary embodiment of FIG. 2*b*, the period length T is considerably shorter than in the exemplary embodiment of FIG. 2*b*, because the format length L of the sheets 1 of FIG. 2*b* is shorter than the format length L in FIG. 2*a*. The spacings A between the individual sheets 1 are of equal size in FIG. 2*b* and in FIG. 2*a*. This is true in a special exemplary embodiment of the invention but is not compulsory; it is also possible for the spacing A to become shorter when the format length L of the sheets 1 becomes shorter. In particular, however, independently of the various exemplary embodiments of the invention, the spacing A is always selected so that it is less than 20% of the maximum format length of the sheets to be handled or processed by the machine.

If the otherwise non-illustrated machine has a plurality of machine elements which perform transporting/handling or processing of the sheets 1, then these machine elements are adapted synchronously to one another along the lines of what is described hereinabove, that is, the control/regulation/operation of these machine elements is effected synchronously with the particular format length involved, or with the especially arbitrary spacings A between the individual sheets 1.

Figure 3:
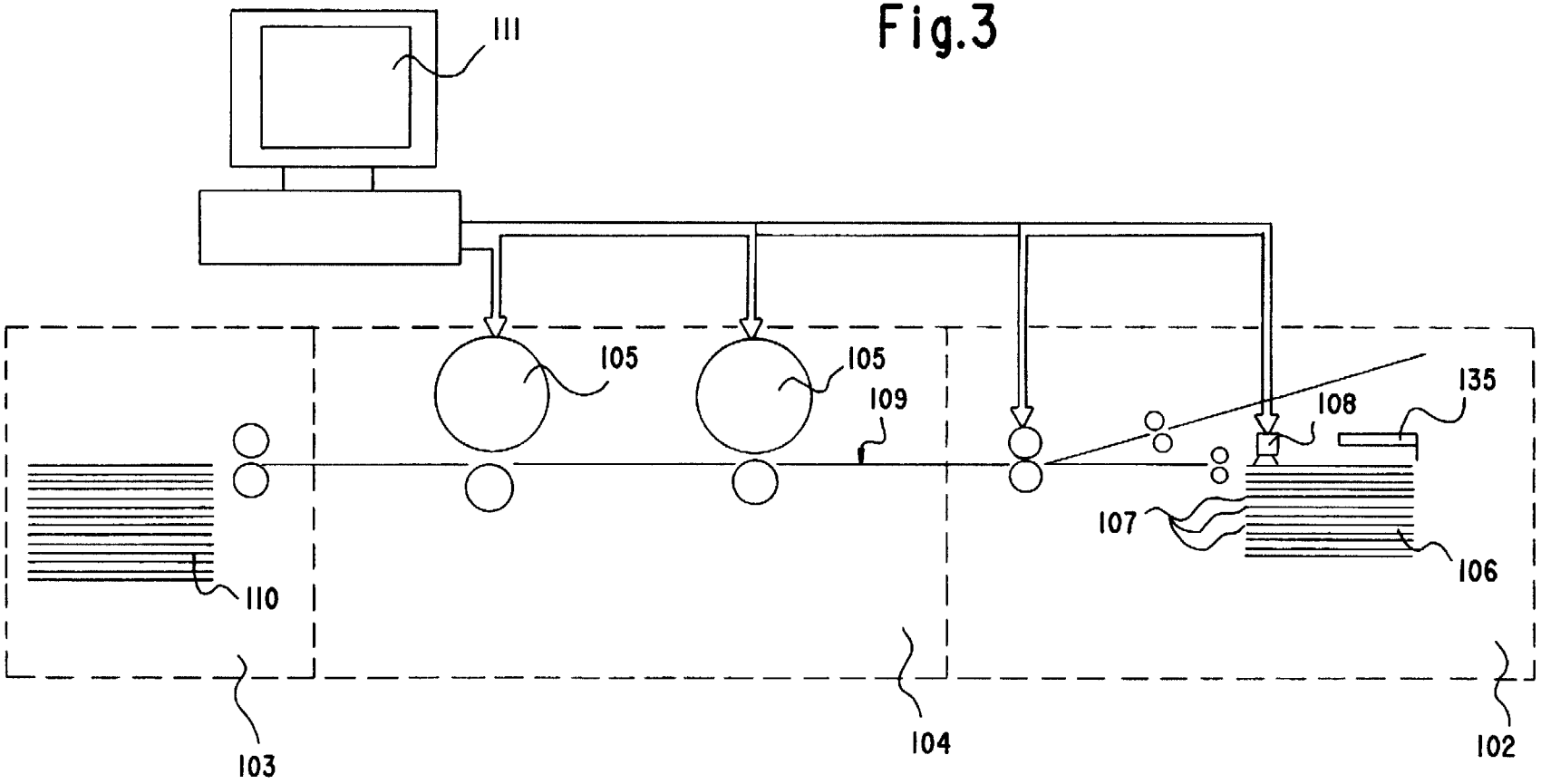
FIG. 3 is a diagrammatic view of a sheet-fed printing press utilizing the method according to the invention.

FIG. 3 shows, in a diagrammatic view, a sheet-fed printing press 101 having a feeder 102 and a delivery 103. Between the feeder 102 and the delivery 103 are printing units 104. The printing units 104 have impression cylinders 105 which are formed as so-called reprintable impression cylinders, that is, a multiplicity of tightly spaced pixels are distributed over the outer cylindrical surface of the respective impression cylinder, the pixels are digitally triggerable and, in accordance with the triggering, either printing ink is accepted or no printing ink is accepted. A result thereof is that the subject or motif to be printed is formed in fractions of seconds by means of a digital electronic system and, during the rotation of the impression cylinder, can be varied. In this manner, it is possible to imprint the printing material or stock in a desired manner, changes in the subject or motif being able to be effected continuously and/or also varying formats being printable.

As is apparent from FIG. 3, the feeder 102 has a sheet pile 106 assigned thereto from which sheets 107 are taken by means of a suction device 108 and fed to a transport segment 109, by means of which the sheets are then conducted to the individual printing units 104 and finally reach the delivery 103 where they are deposited on a sheet pile 110. The computer 111 shown in FIG. 3 symbolizes that the triggering of the impression cylinder 105 is effected digitally in the herein aforedescribed manner.

Figure 4:
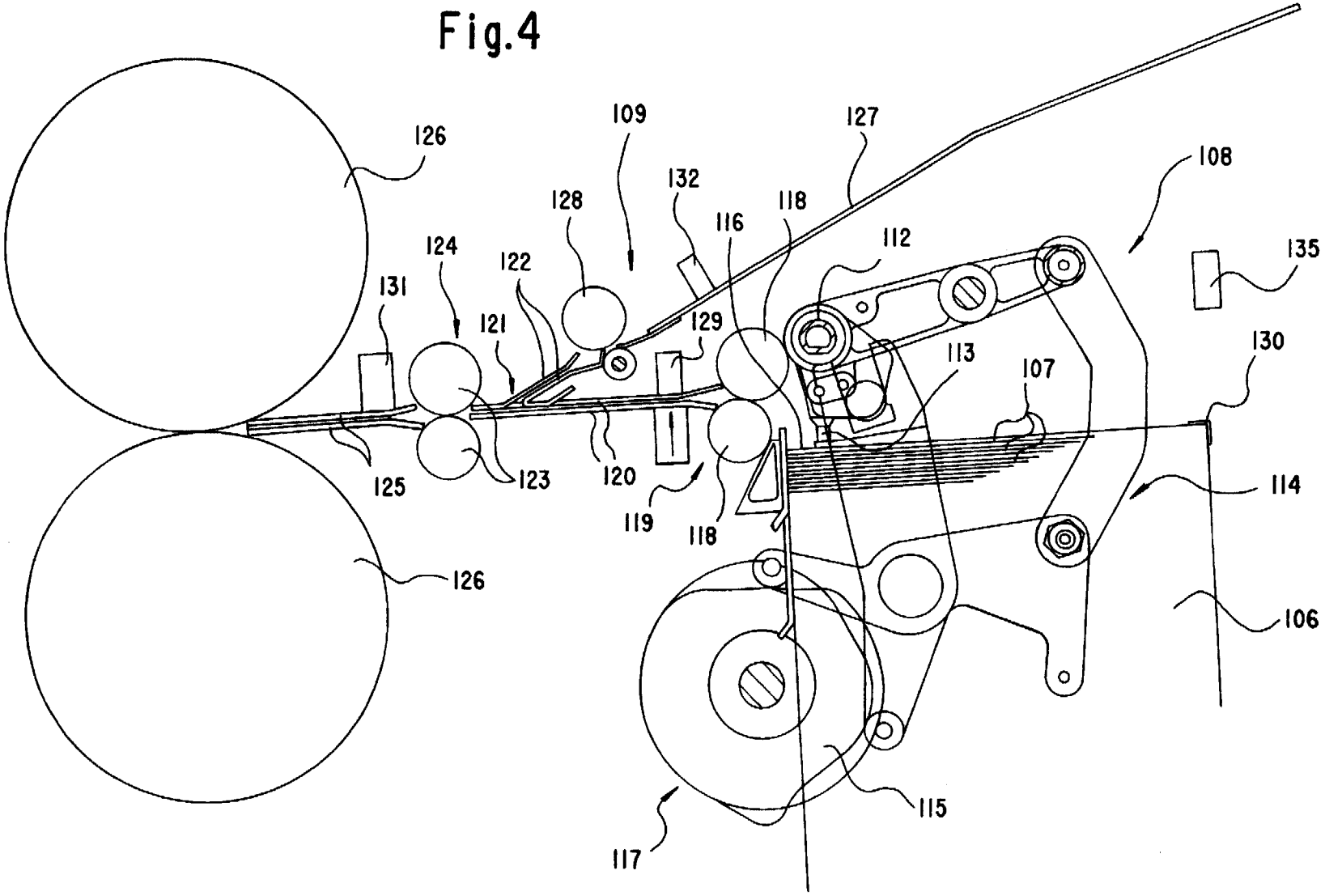
FIG. 4 is an enlarged, fragmentary diagrammatic view of FIG. 3 showing a feeder of the printing press in greater detail.

In FIG. 4, the construction of the suction device 108 of the transport segment 109 is shown in detail. It is believed to be apparent that the suction device 108 has a suction bar 112 cooperating with suckers 113 which can be moved by a control shaft 115 through the intermediary of a sucker drive transmission 114, so that they apply suction to the suitably uppermost sheet 107 for singling or separating the sheet 107 from the rest of the sheet pile 106, and feed the sheet 107, with the leading edge 116 thereof leading, to the transport segment 9. The control shaft 115 represents a first drive 117.

The transport segment 109 has two mutually opposing acceleration rollers 118 which are drivable by a second drive 119 which is not further detailed in FIG. 4. A sheet guide 120 is connected to the acceleration rollers 118 and terminates in an opening or mouth 121 of a further and second sheet guide 122 extending at an inclination from above, as shown in FIG. 4. At the end of the sheet guide 120, mutually opposing transport rollers 123 are disposed which are driven by an otherwise non-illustrated third drive 124. A third sheet guide 125 is connected to the transport rollers 123 and extends to a printing unit, represented by cylinders 126, of the sheet-fed printing press 1. The second sheet guide 122 extends to a single-sheet unit 127 whereon single sheets, such as the sheet 107, can be placed and can, by means of a single-sheet drive 128, be fed at a suitable moment to the second sheet guide 122 and introduced thereat into the sheet guide 120. The herein aforementioned single-sheet unit 127 can be constructed alternatively or additionally also as a second sheet pile like the sheet pile 106, so that the sheet-fed printing press 1 operates with two piles.

A first sheet sensor 129 is disposed between the acceleration rollers 118 and the transport rollers 123, somewhat at the beginning of the of the sheet guide 120, and detects the leading edges 116 of the sheets 107 oncoming therefrom, as they pass the transport segment 109. The location of the trailing edges 130 of the sheets is calculated, respectively, by the leading-edge location and the sheet length. It is particularly possible thereby to attain a spacing of zero between adjacent sheets 107. The sheet length is determined by means of a length sensor 135 assigned to the sheet pile 106 or introduced manually into a control device. It is also possible, in a test run, to measure a sheet 107 by means of the sheet sensor 129 or another and second sheet sensor 131. By a knowledge of the position of the leading edge of the sheet and the length of the sheet, the position of the trailing edge of the sheet is always precisely fixed. Thereby, the leading edge of a succeeding sheet is able to be positioned in relation the the trailing edge of the preceding sheet precisely with respect to the spacing therebetween. As viewed in the transport direction, the aforementioned second sheet sensor 131 lies behind the transport rollers 123, preferably at the beginning of the third sheet guide 125. The second sheet sensor 131 determines thereat the precise location of the leading edges 116 of the oncoming sheets 107. The single-sheet unit 127 has a third sheet sensor 132 assigned thereto which is in a position to detect the sheets 107 deposited on the single-sheet unit 127.

During operation, the suction device 108 lifts the uppermost sheet 107 from the sheet pile 106 and guides the leading edge 116 thereof between the acceleration rollers 118, so that the sheets 107 are transported into into the sheet guide 120. The first sheet sensor 129 then accepts the leading edge 116 of the sheet 106. The suction device 108 controlled in a manner that a new sheet 107 is singled or separated and fed to the acceleration rollers 118 the instant that the trailing edge of the preceding sheet 107 has left the vicinity of the suction device 108. The acceleration rollers 118 accelerate the new sheets until the leading edge 116 thereof reaches the trailing edge 130 of the preceding sheet 107. The aforedescribed method of introducing new sheets 107 into the transport segment 109 is continuously repeated in the aforedescribed manner. The second sheet sensor 131 determines, during operation, the precise location of the leading edge 116 of the respectively oncoming sheet 107 accordingly controls the impression cylinder 105 of the sheet-fed printing press 101, so that the subject or motif to be transferred is available in a desired manner the instant the appertaining sheet reaches the printing units. Because reprintable printing units are involved, which are electronically triggered, the subject or motif formation on the impression cylinders is controlled in accordance with the desired printing image and as a function of the format of the respectively oncoming sheet, the successive sheets indeed being able to have varying formats. This format matching is effected not only with respect to the impression cylinders of the printing units, but rather also with respect to the components of the transport segment. In this regard, the aforementioned three drives 117, 119 and 124 are provided with separate motors, so that they can be controlled individually, and so that, depending upon the desired result and existing sheet format, the feeder control of the suction device 108, the acceleration rollers 118 and the transport rollers 123 are able to be triggered and driven independently of one another.

When a single sheet has been deposited on the single-sheet unit 127, it is detected by the third sheet sensor 132 and, at the right moment, it triggers the single-sheet drive 128 so that the thus detected single sheet 107 passes the second sheet guide 122 and, by means of the mouth 21 is sleuced or channeled into the end region of the sheet guide 120. This occurs in a manner that the leading edge 116 of the thus channeled sheet reaches the trailing edge 130 of the preceding sheet 107 which comes from the sheet pile 106. During the channeling, no feeding of new sheets 107 from the sheet pile 106 occurs. This interruption continues until it is possible for the feeding of a new sheet 107 from the sheet pile 106 to be resumed so that the leading edge 116 of the next new sheet 107 can be guided by means of the acceleration rollers 118 up to the trailing edge 130 of the channeled sheet 107.

By means of the sheet travel control according to the invention, maximum effectiveness and tight or close sheet successions are achieved so that, due to the acceleration of the sheets 107, the time for singling or separation, which determines the press productivity, can be increased considerably. The sheet frequency is thereby increased. In the printing process, the feeding occurs tightly or closely one after the other, sheet on sheet, so that printings/hour is no longer a subject of discussion, but rather, meters/hour. It is possible to process changing sheet formats continuously. Parts which demand great expense or outlay, for example, the high energy outlay of blast air which is required for blowing on and accordingly for guidance of the sheets 107, are much better utilized due to invention of the instant application.

The term sheet as used herein is meant to include any flat substrate stock whether made of paper, plastic material, pasteboard, film and so forth.

I claim:

1. Method for transporting/handling sheets along at least one transport/handling segment in a machine, the machine including a feeder pile and a single-sheet unit, the method which comprises supplying sheets of a given length to and removing sheets from the machine, the transport/handling segment having a period length for successive sheets which is dependent upon the format length of the respective sheets, determining at least once, in a first determination, a position of a respective sheet within the transport/handling segment, and selectively introducing a new sheet into the transport/handling segment either from the feeder pile or from the single-sheet unit, and accelerating the new sheet until a given distance has been adjusted between the respective sheet and the new sheet.

2. The method according to claim 1, which includes spacing the successive sheets a distance from one another independently of the format length of the sheets.

3. The method according to claim 2, which includes selectively predetermining the spacing between the successive sheets.

4. The method according to claim 2, which includes establishing a spaced distance between the successive sheets at less than approximately 20% of the format length of the respective sheets.

5. The method according to claim 4, which includes selectively predetermining the spaced distance.

6. The method according to claim 2, which includes establishing a spaced distance between the successive sheets at less than approximately 20% of a maximum format length of the sheets to be handled by the machine.

7. The method according to claim 6, which includes selectively predetermining the spaced distance.

8. The method according to claim 2, which includes controlling/regulating at least one machine element of the machine in synchronism with at least one of the respective format length of the respective sheets and a spaced distance between respective successive sheets.

9. The method according to claim 8, wherein the machine is a printing press and the machine element is at least one of a printing unit and feeding and delivery devices of the printing press.

10. The method according to claim 2, wherein each of the sheets has a leading edge, and the method further comprises controlling/regulating at least one machine element of the machine in at least one of synchronism and register with the leading edge of a respective sheet.

11. The method according to claim 10, wherein the machine is a printing press and the machine element is at least one of a printing unit and feeding and delivery devices of the printing press.

12. The method according to claim 1, wherein each of the sheets has a trailing edge, and which includes introducing a new sheet into the segment the instant the trailing edge of a respectively preceding sheet has reached a given position.

13. The method according to claim 12, which includes determining the position of the sheet by means of a first sheet sensor.

14. The method according to claim 13, wherein the sheet position is calculated.

15. The method according to claim 13, wherein each of the sheets has a leading edge, and the method further comprises determining the position of the sheet by determining a location of the leading edge of the sheet.

16. The method according to claim 12, which includes calculating a position of the trailing edge of the sheet.

17. The method according to claim 12, wherein each of the sheets has a sheet length, and the method further comprises determining the sheet length by means of a length sensor.

18. The method according to claim 12, wherein each of the sheets has a sheet length, and the method further comprises determining the sheet length by measuring a test sheet.

19. The method according to claim 12, which includes introducing the new sheet when the trailing edge of a respectively preceding sheet has moved away from a suction device for handling the sheet.

20. The method according to claim 12, wherein each of the sheets has a leading edge, and the method further comprises, after introducing a new sheet, moving the new sheet to the trailing edge of the preceding sheet in a manner that a predetermined spaced distance is formed between the trailing edge of the preceding sheet and the leading edge of the new sheet.

21. The method according to claim 12, which includes setting a spaced distance between the preceding sheet and a new sheet at zero distance.

22. The method according to claim 12, which includes determining a location of the sheet in the segment in a second determination and, by means of which triggering a subject of at least one reprintable impression cylinder.

23. The method according to claim 22, which includes determining a location of the leading edge of a respective new sheet in the second determination.

24. The method according to claim 22, wherein the introducing step includes channeling a single sheet into the segment by introducing a single sheet into a position on a single-sheet unit, detecting the single sheet in the single-sheet unit by means of a third determination of the position of the sheet and in accordance therewith as well as with the first determination of the position of the sheet and/or the second determination of the position of the sheet, channeling the sheet definitely between a preceding sheet and a new sheet.

25. The method according to claim 12, wherein each of the sheets has a sheet length, and the method further comprises determining the sheet length from data introduced into a control device of the press.

26. A method of transporting/handling sheets along a transport/handling segment in a sheet-processing machine, which comprises:

supplying sheets of a given format length from a feeder pile into the transport/handling segment;

defining a period length for successive sheets in the transport/handling segment in dependence on the format length of the sheets;

defining the respective sheet within the transport/handling segment as a first sheet and determining a position of the first sheet within the transport/handling segment;

immediately introducing a second sheet into the transport/handling segment when the first sheet has reached a given position, and accelerating the second sheet until a given spaced distance has been attained between the first and second sheets within the transport/handling segment.

* * * * *